US005615539A

United States Patent [19]

Graham

[11] Patent Number: 5,615,539

[45] Date of Patent: Apr. 1, 1997

[54] EQUINE HALTER

[76] Inventor: Lewis V. Graham, 5 Thor Ave., Succasunna, N.J. 07876

[21] Appl. No.: 635,278

[22] Filed: Apr. 19, 1996

Related U.S. Application Data

[63] Continuation-in-part of Ser. No. 563,075, Nov. 27, 1995, abandoned.

[51] Int. Cl.[6] ..... B68B 1/02

[52] U.S. Cl. ..... 54/24; 54/13

[58] Field of Search ..... 54/6.1, 6.2, 12, 54/13, 24; 119/865

[56] References Cited

U.S. PATENT DOCUMENTS

| | | | |
|---|---|---|---|
| 3,605,384 | 9/1971 | Pacini | 54/24 |
| 4,135,348 | 1/1979 | Matthews | 54/24 |
| 4,376,366 | 3/1983 | Miller | 54/24 |
| 4,917,049 | 4/1990 | Peterson | 119/865 X |

FOREIGN PATENT DOCUMENTS

| | | | |
|---|---|---|---|
| 2274048 | 7/1994 | United Kingdom | 54/24 |

*Primary Examiner*—Robert P. Swiatek
*Attorney, Agent, or Firm*—Bernard J. Murphy

[57] ABSTRACT

In a first embodiment, the crownpiece strap of a halter is subdivided, and Velcro-type hook-and-loop fastener material is affixed to the subdivided ends of the crownpiece, and the ends pressed together. Accordingly, the crownpiece will open, and release the haltered horse, if the halter becomes snared or entangled. In an alternative embodiment, a halter strap has the hook-and-loop fastener material on a terminating end thereof, with the hook material and the loop material separated therebetween. Then the strap is looped or folded over a halter ring, with the hook material and loop material adhered together. Again, upon the halter being strained, with tensile force being applied to the looped or folded over strap, the same will open to free the horse from any entanglement.

14 Claims, 2 Drawing Sheets

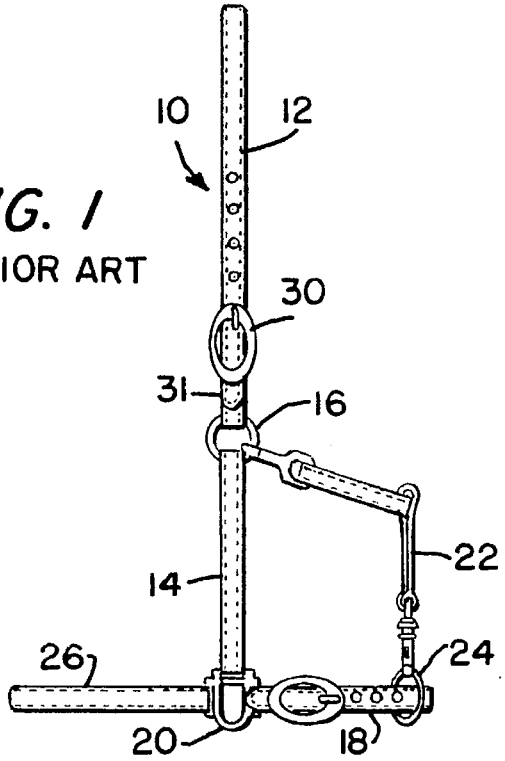
FIG. 1
PRIOR ART
FIG. 4
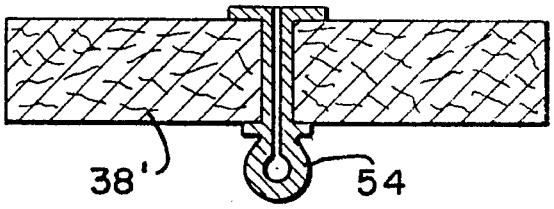
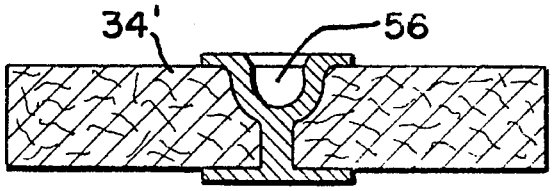
FIG. 5
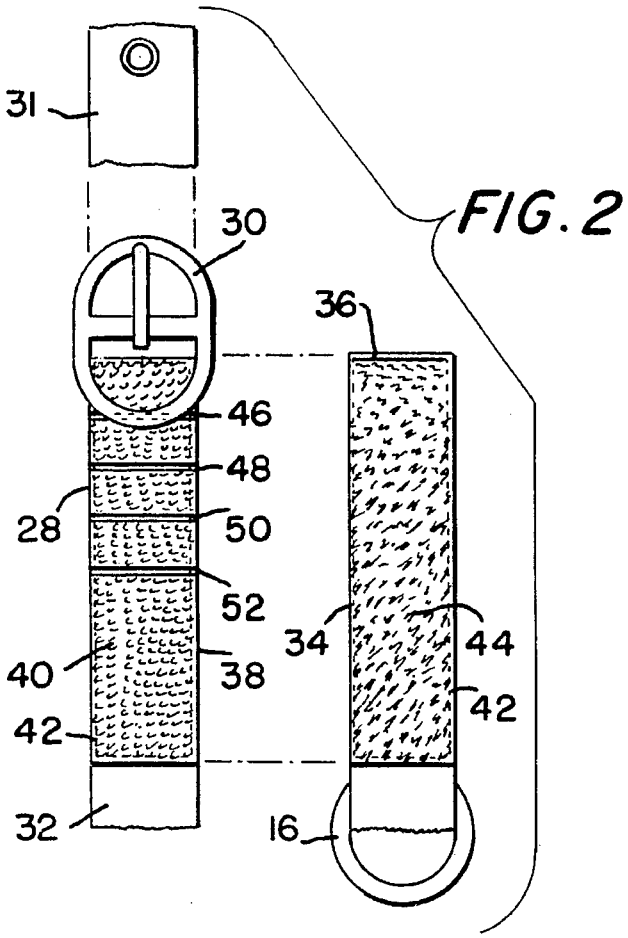
FIG. 2

FIG. 8
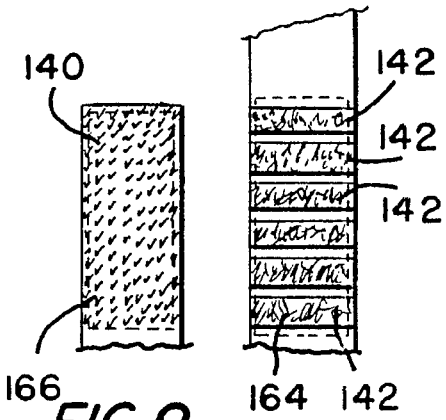
FIG. 9
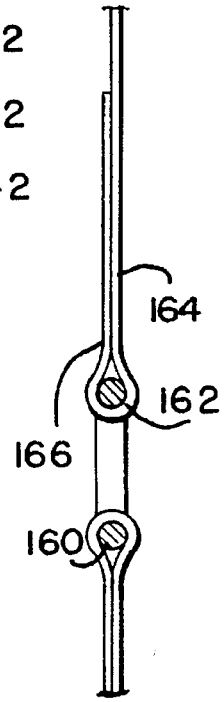
FIG. 7
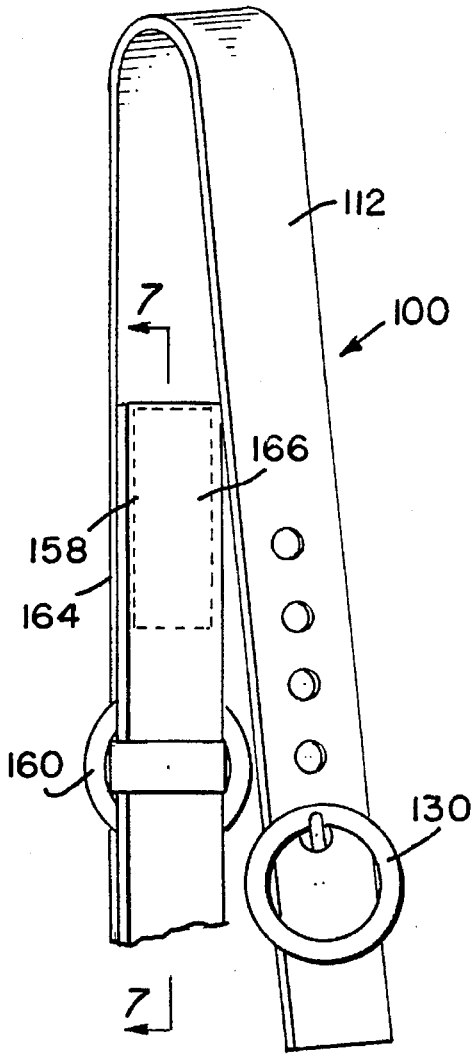
FIG. 6
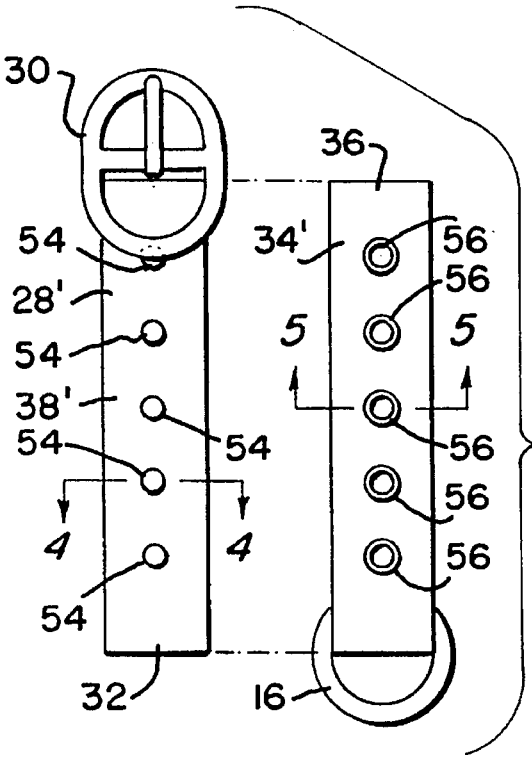
FIG. 3

EQUINE HALTER

This application is a continuation-in-part of application Ser. No. 08/563,075, filed Nov. 27, 1995, now abandoned.

This invention pertains to halters, the article formed of interconnected straps and noseband, used for emplacement about a horse's head in order to restrain or lead the animal, and in particular to an improved halter designed to reduce the possibility of injury to the animal.

The typical equine halter has halter rings to which lead ropes are attached, by means of a snap, or the like, in order that the horse can be lead, or tethered to a secure support, or restrained in a trailer. If the animal panics when tethered or otherwise restrained, the known halters will not release and, accordingly, neck or head injuries can result. If the haltered horse is tied, and starts to pull back when a handler approaches, the handler has to grasp the halter, in order to release it, while the horse is struggling. This is dangerous for both horse and handler. More, when a haltered horse is in the paddock or out in a pasture, there arises the possibility that the halter will get snagged on some structure. Again, in the circumstances, the horse will panic, struggle, and can suffer some severe injury or even strangulation.

There has been a long unmet need for a forgiving halter, that is a halter which, when subjected to some tensile strain, due to any of the aforesaid circumstances, will release the animal before any injury occurs, and will obviate any necessity for a handler to grasp the halter to effect the release.

It is an object of this invention, then, to set forth an improved, equine halter which satisfies the long sought need. Particularly, it is an object of this invention to disclose an improved, equine halter, having a first element comprising a crownpiece, second elements, comprising cheekpieces connected to said crownpiece, a third element comprising a chin strap connected to said cheekpieces, a fourth element comprising a throat latch connected to said chin strap and intermediate said cheekpieces and said crownpiece, and a fifth element comprising a noseband connected to said chin strap, wherein the improvement comprises a separation of one of said elements into first and second, discontinuous terminations, and means, affixed to said terminations (a) for attaching said terminations together, and (b) responsive to opposing tensile forces applied to said terminations for effecting separation of said terminations.

It is another object of this invention to set forth an improved, equine halter, having a first element comprising a crownpiece, second elements comprising cheekpieces connected to said crownpiece, a third element comprising a chin strap connected to said cheekpieces, a fourth element comprising a throat latch connected to said chin strap and intermediate said cheekpieces and said crownpiece, a fifth element comprising a noseband connected to said chin strap, and an annulus, wherein the improvement is comprised by one of said elements having a free end; and wherein said free end of said one element is doubled upon itself to form (a) a loop thereof, and (b) mutually confronting and engaging portions of said one element; said loop is enwrapped about a portion of said annulus; and further including means affixed to said mutually confronting and engaging portions of said one element for (a) causing said engaging portions to adhere to each other, releasably, and (b) releasably accommodating a separation of said portions, in response to a tensile force applied to said one element.

Further objects of this invention, as well as the novel features thereof, will become apparent by reference to the following description, taken in conjunction with the accompanying figures, in which:

FIG. 1 is a plan view of a typical, prior art equine halter;

FIG. 2 is a plan view of a portion of a crownpiece, shown with the buckle and tab therefor separated, the buckle-holding portion thereof having a discontinuous termination, and a continuing portion of the crownpiece, having a halter ring secured thereto at one end, and another discontinuous termination at the opposite end, according to an embodiment of the invention;

FIG. 3 is a view, like that of FIG. 3, albeit absent the tab for the buckle, depicting an alternative embodiment of the invention;

FIG. 4 is a cross-sectional view taken along section 4—4 of FIG. 3; FIG. 5 is a cross-sectional view taken along section 5—5 of FIG. 3. FIGS. 4 and 5 are considerably enlarged over the scale of FIG. 3;

FIG. 6 is a perspective illustration of a crownpiece, the same incorporating another alternative embodiment of the invention;

FIG. 7 is a cross-sectional view taken along section 7—7 of FIG. 6;

FIG. 8 is a frontal, elevational view of a portion of one of the engaging portions of the free end of the crownpiece of FIGS. 6 and 7; and FIG. 9 is a frontal, elevational view of portion of the other of the engaging portions of the aforesaid free end.

As shown in FIG. 1, a typical, prior art equine halter 10 has a crownpiece 12 and cheekpieces 14 connected to the crownpiece 12 by means of a halter ring 16. A chin strap 18 is connected to the cheekpieces 14 by means of another halter ring 20. A throat latch 22 is connected to the chin strap 18, via another halter ring 24, and intermediate the cheekpieces 14 and crownpiece 12 by halter ring 16. Finally, a noseband 26 is connected to the chin strap 18 via the halter ring 20.

This prior art halter 10, as can be appreciated, is not forgiving. IF the horse is tethered, and panics, or if the halter becomes snagged, it will not release the animal.

According to my invention, the novel, forgiving halter comprises all the constituent components therefor as set forth in FIG. 1, with one, inventive change. In my innovative halter the crownpiece 12 is supplanted with the crownpiece 28 shown in FIG. 2, in a significant portion thereof. Crownpiece 28 has the same buckle 30 and tab 31, as shown in FIG. 1, and for a clear exposition of the improvement, the buckle and tab are shown in separation. The buckle-bearing portion of the crownpiece 28, however, is not coupled to the halter ring 16. Rather, it has a discontinuous termination 32. Crownpiece 28 has a separate strap portion 34 to which the halter ring 16 is secured, at one end, and further has a similar, discontinuous termination 36.

On the facing surface of the buckle-bearing portion 38 of crownpiece 28 is a strip of Velcro-type hook material 40, the same having been secured thereto by stitching 42. The separate strap portion 34 also has Velcro-type loop material 44 stitched to the facing surface thereof. In each case, the materials 40 and 44, in this embodiment of the invention, have a width of approximately one inch, and a length of four inches. The thus separated crownpiece 28 is made continuous, by the simple expedient of pressing the materials 40 and 44 together, with the four-inch length of the one fully engaging the four-inch length of the other.

Experimentation has demonstrated that, if the crownpiece 28 is snagged on a rigid projection, and the horse is haltered with my novel halter, the animal's pull on the snagged halter, putting approximately twenty pounds of opposing tensile forces on the terminations 32 and 36, the crownpiece 28 will separate and release the horse. Such is the eventuality, with the four-inch lengths of the materials 40 and 44 fully engaged. However, the invention comprehends means for enabling a separation of the mutually-adhered portions 34 and 38 at selected increments of the aforesaid opposing tensile forces. The hook material 40, as can be seen in FIG. 2, has four, transverse discontinuities 46, 48, 50 and 52. The latter occur at half-inch intervals. The discontinuities comprise visual indicia for enabling the differing tensile-force separation. With strap portion 34 and its termination 36 aligned with discontinuity 46, and then the portions 34 and 38 being adhered together, it will require such tensile forces of approximately seventeen and a half pounds to effect crownpiece separation. If termination 36 is aligned with discontinuity 52, the separation will occur with only ten pounds of tensile force.

Discontinuities 48 and 50 represent adhering alignments which will effect crownpiece 28 separation with fifteen and twelve-and-a-half pounds of tensile forces, respectively. Such selective releasibility is a particularly beneficial feature. The handler can contemplate the strength of the horse, and determine how separable or inseparable to make the halter, wishing to insure that the animal will not be subject to injury, on the one hand, but will not too easily be freed on the other if tethered and unattended.

The transverse discontinuities 46, 48, 50 and 52, then, comprises means for visually indicating whereat attachment together of said terminations 32 and 36 will enable the tensile-forces caused separation to occur at selected increments of such opposing tensile forces.

FIGS. 3 through 5 disclose an alternative embodiment of the invention in which the crownpiece 28' employs snap fasteners in lieu of the Velcro-type materials.

The buckle-bearing portion 38' of the crownpiece 28' has a series of projections fixed thereto, and the separate strap portion 34' has a series of apertures embedded therein. The projections 54 are receivable in the apertures 56, according to known snap fastener practice, with a releasably tight fit. Patently, by engaging all five of the projections 54 with the five apertures 56, the portions 38' and 34' will be held together with a maximum tenacity. Again, however, if it is desirable to modulate the separability of the portions 38' and 34', lesser numbers of the projections 54 can be engaged with a like, lesser number of the apertures.

The forgivability of the alternate embodiment of the invention, i.e., the force which will cause the crownpiece 28' to separate, will depend upon the quality of the snap fasteners, and/or the numbers of projections 54 and apertures 56 which are provided. In this embodiment, by way of example, five of each are employed, and the same are approximately three-quarters of an inch apart.

FIGS. 6 through 9 depict another, alternative embodiment of the invention, namely the halter 100, which is represented, in FIG. 6, only by the crownpiece 112 thereof. The rest of the halter 100 can be considered to be substantially the same as the halter 10. In this embodiment, halter 100 has the crownpiece engaged with a buckle 130, as is quite conventional. However, the opposite end of the crownpiece 112 has a free end 158 which is doubled upon itself to form a loop 162 thereof, as well as mutually confronting and engaging portions 164 and 166. In this configuration, the loop 162 is enwrapped about a portion of a halter ring 160. Engaging portion 164, as shown in FIG. 8, has Velcro loop material 142 fixed thereon, by stitching, whereas engaging portion 166, as shown in FIG. 9, has Velcro hook material 140 fixed thereon. With the free end 158 enwrapped about the halter ring 160, and the portions 164 and 166 engaged with each other, releasably, the crownpiece 112 will separate upon a sufficient tensile force being applied to the crownpiece; the portions 164 and 166 will disengage. Similarly, as disclosed in FIG. 2, portion 164 has a plurality of separations obtaining in the Velcro material 142. The same enable a separation of the materials 140 and 142 in response to given increments of tensile force by the simple expedient of having material 140 adhere to selected numbers of the transverse strips of loop material. The separations or interruptions of the loop material 142, then, offer a visual indicia for accommodating separation of the portions 164 and 166 at the tensile force increments.

As shown, the free end 158 is looped about the halter ring 160. Optionally, this embodiment offers a means for dispensing with the buckle 130. In lieu of the buckle 130, another halter ring, or some similar annulus, could be employed with a crownpiece free end, having Velcroed portions, like portions 164 and 166, enwrapped about a portion of the further ring or annulus. The interruptions of loop material 142 can be used, with selected positioning of the hook material 140 of portion 166 thereon, and adhering thereto, to adjust the effective length of the crownpiece 112. Accordingly, the crownpiece could have the free end 158 with its mutually adhering portions 164 and 166, and another free end at the opposite end of the crownpiece looped about an annulus and employing further Velcroed portions (a) for selectively adjusting the length of the crownpiece, and (b) also accommodating a tensile-forced release. The second free end, enwrapped about an annulus, would render the buckle superfluous.

I have described my invention, in each embodiment thereof, only by way of example, as aforesaid, and not as a limitation to the scope of my invention as set forth in the objects thereof and in the appended claims.

I claim:

1. An improved, equine halter, having a first element comprising a crownpiece, second elements comprising cheekpieces connected to said crownpiece, a third element comprising a chin strap connected to said cheekpieces, a fourth element comprising a throat latch connected to said chin strap and intermediate said cheekpieces and said crownpiece, and a fifth element comprising a noseband connected to said chin strap, wherein the improvement comprises:

a separation of one of said elements into first and second, discontinuous terminations;

means, affixed to said terminations (a) for attaching said terminations together, and (b) responsive to opposing tensile forces applied to said terminations for effecting separation of said terminations; and wherein one of said terminations has means for visually indicating whereat attachment together of said terminations will enable the aforesaid separation to occur at selected increments of said opposing tensile forces.

2. An improved, equine halter, according to claim 1, wherein:

said attaching means comprises a strip of hook fastener material secured to one of said terminations, and a strip of loop fastener material secured to another of said terminations.

3. An improved, equine halter, according to claim 2, wherein:

said strips of material are approximately one inch in width, and have a length of from approximately two inches to approximately four inches.

4. An improved, equine halter, according to claim 2, wherein:

one of said strips of material has transverse indicia thereon.

5. An improved, equine halter, according to claim 4, wherein:

said indicia are approximately half an inch apart from each other.

6. An improved, equine halter, according to claim 1, wherein:

said attaching means comprises snap fasteners, in which one of said terminations has projections thereon, and another of said terminations has apertures for releasably receiving said projections therein.

7. An improved, equine halter, according to claim 1, wherein:

said one element comprises said crownpiece.

8. An improved, equine halter, according to claim 7, wherein:

said crownpiece is connected to said cheekpieces by halter rings; and said attaching means is affixed to said crownpiece in adjacency to one of said halter rings.

9. An improved, equine halter, having a first element comprising a crownpiece, second elements comprising cheekpieces connected to said crownpiece, a third element comprising a chin strap connected to said cheekpieces, a fourth element comprising a throat latch connected to said chin strap and intermediate said cheekpieces and said crownpiece, and a fifth element comprising a noseband connected to said chin strap, wherein the improvement comprises:

a separation of one of said elements into first and second, discontinuous terminations; and means, affixed to said terminations (a) for attaching said terminations together, and (b) responsive to opposing tensile forces applied to said terminations for effecting separation of terminations; wherein said means comprises snap fasteners, in which one of said terminations has projections thereon, and another of said terminations has apertures for releasably receiving said projections therein; and said one termination has a series of five, spaced apart projections thereon, and said another termination has a series of five, spaced apart apertures.

10. An improved, equine halter, according to claim 9, wherein:

said projections are about three-quarters of an inch apart, and said apertures, also, are about three-quarters of an inch apart.

11. An improved, equine halter, having a first element comprising a crownpiece, second elements comprising cheekpieces connected to said crownpiece, a third element comprising a chin strap connected to said cheekpieces, a fourth element comprising a throat latch connected to said chin strap and intermediate said cheekpieces and said crownpiece, a fifth element comprising a noseband connected to said chin strap, and an annulus, wherein the improvement is comprised by:

one of said elements having a free end; and wherein said free end of said one element is doubled upon itself to form (a) a loop thereof, and (b) mutually confronting and engaging portions of said one element;

said loop is enwrapped about a portion of said annulus; and further including means affixed to said mutually confronting and engaging portions of said one element for (a) causing said engaging portions to adhere to each other, releasably, and (b) releasably accommodating a separation of said portions, in response to a tensile force applied to said one element; and wherein one of said portions has means for visually indicating whereat adhering together of said portions will enable the aforesaid separation to occur at selected increments of said tensile force.

12. An improved, equine halter, according to claim 11, wherein:

said attaching means comprises hook fastener material secured to one of said engaging portions, and loop fastener material secured to another of said engaging portions.

13. An improved, equine halter, according to claim 12, wherein:

said material secured to said one engaging portion, and said material secured to said another engaging portion are of substantially a common length.

14. An improved, equine halter, having a first element comprising a crownpiece, second elements comprising cheekpieces connected to said crownpiece, a third element comprising a chin strap connected to said cheekpieces, a fourth element comprising a throat latch connected to said chin strap and intermediate said cheekpieces and said crownpiece, a fifth element comprising a noseband connected to said chin strap, and an annulus, wherein the improvement is comprised by:

one of said elements having a free end; and wherein said free end of said one element is doubled upon itself to form (a) a loop thereof, and (b) mutually confronting and engaging portions of said one element;

said loop is enwrapped about a portion of said annulus; and further including means affixed to said mutually confronting and engaging portions of said one element (a) for causing said engaging portions to adhere to each other, releasably, and (b) releasably accommodating a separation of said portions, in response to a tensile force applied to said one element; wherein said means comprises hook fastener material secured to one of said engaging portions, and loop fastener material secured to another of said engaging portions; and said fastener material secured to one of said engaging portions has a plurality of transverse interruptions.

* * * * *